US006715394B2

(12) United States Patent
O'Dell et al.

(10) Patent No.: US 6,715,394 B2
(45) Date of Patent: Apr. 6, 2004

(54) ROTATABLE DIE

(75) Inventors: Michael O'Dell, DeSoto, KS (US); Michael Criss, Kansas City, KS (US)

(73) Assignee: W+D Machinery Co., Inc., Overland Park, KS (US)

( * ) Notice: Subject to any disclaimer, the term of this patent is extended or adjusted under 35 U.S.C. 154(b) by 67 days.

(21) Appl. No.: 10/140,459

(22) Filed: May 7, 2002

(65) Prior Publication Data

US 2003/0209123 A1 Nov. 13, 2003

(51) Int. Cl.[7] ..... B26D 7/26

(52) U.S. Cl. ..... 83/698.61; 83/100; 83/663; 83/698.21; 83/698.51

(58) Field of Search ..... 83/100, 663, 698.21, 83/698.41, 698.42, 698.51, 698.61

(56) References Cited

U.S. PATENT DOCUMENTS 3,752,042 A * 8/1973 Castille ..... 83/698.51 X
4,878,407 A * 11/1989 Harrison et al. ..... 83/663 X
5,088,367 A * 2/1992 Cracchiolo et al. ..... 83/663 X
5,213,371 A 5/1993 Bradley ..... 283/56
5,555,786 A * 9/1996 Fuller ..... 83/698.21 X
5,782,156 A * 7/1998 Collins ..... 83/100 X
6,076,444 A * 6/2000 Okonski ..... 83/100 X
6,119,570 A 9/2000 Okonski et al. ..... 83/522.15
6,205,899 B1 * 3/2001 Blumle et al. ..... 83/100 X
6,494,123 B2 * 12/2002 Fuchs ..... 83/698.51

OTHER PUBLICATIONS

Winkler + Dünnebier brochure entitled "Rotary Reel–Fed Envelope Machine", dated Nov., 1999.
Winkler + Dünnebier brochure entitled "Machine for Manufacturing Pockets and Booklets", dated Oct., 1999.

* cited by examiner

*Primary Examiner*—Charles Goodman
(74) *Attorney, Agent, or Firm*—Shook, Hardy & Bacon LLP

(57) ABSTRACT

A die that may be rotated relative to a die holder to form an opening in different types of envelopes, cardboard boxes or other type of blanks or webs is provided. The window opening in an envelope blank is formed by using a sheet of material having a top surface and an outer periphery. A raised portion extends from the top surface of the sheet and includes a cutting edge adapted to cut the envelope blank to form the opening. A coupling means are included to selectively couple the die with the die holder in at least two orientations so that the position of said sheet may be changed relative to the die holder to alter the location in which said cutting portion forms the opening in the envelope blank.

29 Claims, 2 Drawing Sheets

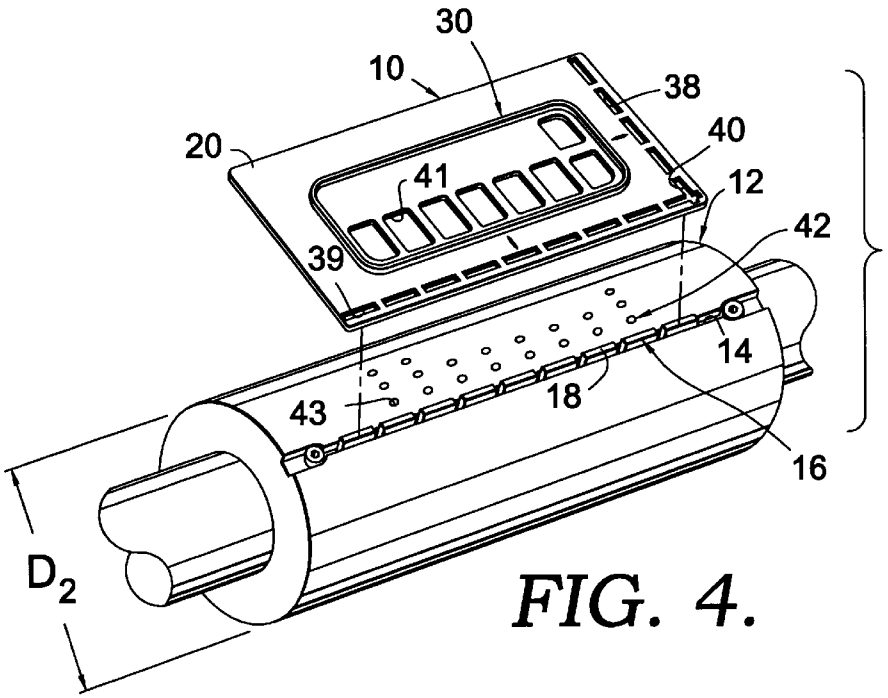
FIG. 4.
FIG. 3.
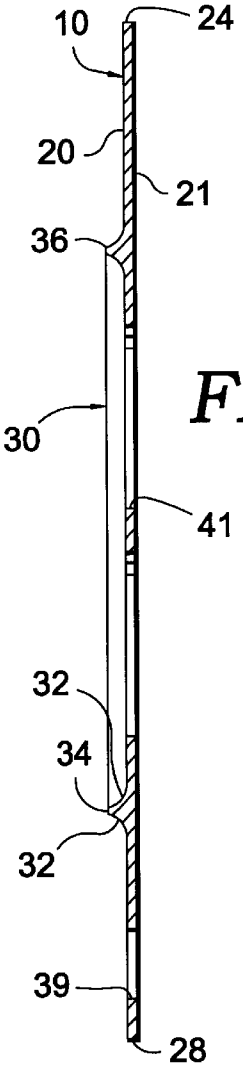

ROTATABLE DIE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a die for cutting an opening in a blank or web. More particularly, this invention relates to a flexible die that is capable of being rotated on a die holder to change the location where an opening, or window portion, is formed in the blank or web used to form an envelope, cardboard box or the like.

It is well known in the art to provide for a window opening in the face or back side of an envelope. The window portion allows for the viewing of an address or other information contained within the envelope.

Typically, a cylindrical die holder is used to place a die in position to cut the window opening in the envelope blank as the blank is moved past the die during the envelope forming process. The die can include a set of apertures, such as rectangular slots, that is adapted to affix the die to the die holder. The die further includes a cutting edge of any suitable shape. A rectangular shaped cutting edge is commonly used to form window envelopes. Generally, there are two types of dies that are used to form these rectangular window openings in different styles of envelopes. One type of die includes a cutting edge the longer edge of which is aligned in a direction parallel to the long axis of the die. Another type of die includes a cutting edge the longer edge of which is aligned in a direction that is perpendicular to the long axis of the die. This type of die is typically used with a larger diameter die holder to form a window opening in open-end style envelopes.

The aforementioned die configurations suffer from a number of drawbacks and deficiencies. For instance, two different dies must be used when manufacturing a standard size ten envelope and a larger open-end manilla type envelope. If the die used to form a window opening in a standard sized ten envelope is instead used on a larger diameter die holder (such as is used to form a window opening in open-ended style envelope), the window opening formed in the open end style envelope would not be positioned properly. Therefore, different dies must be used to properly position the window opening positioned in most different styles of envelopes. Using two different dies to form a window opening in different styles of envelopes increases manufacturing costs. Furthermore, the cost, time and effort required to purchase and maintain a separate inventory of dies for different envelope styles is increased.

Accordingly, there remains a need for a die that will reduce the cost of manufacturing envelopes having window openings formed therein. In addition, there also remains a need to reduce the number of dies that need to be stored and maintained in inventory. The present invention fills these needs as well as various other needs.

BRIEF SUMMARY OF THE INVENTION

In order to overcome the above-stated problems and limitations, there is provided a die that can be placed in more than one position relative to a die holder to allow the die to form window openings in various styles of envelopes, cardboard boxes formed from blanks or webs. In addition, rotating the die on the die holder allows the die to work with different die holder running cycles.

In general, the window or other type of opening in a blank or web is formed by using a die comprising a sheet of material having a top surface and an outer periphery. A raised portion protrudes from the top surface of the sheet and includes a cutting edge that is adapted to cut the blank or web to form a window opening as the blank or web passes the die. A first set of apertures comprises at least one first aperture and is formed in the sheet for coupling the sheet with the die holder in a first orientation with respect to the die holder. A second set of apertures comprises at least one second aperture and is formed in the sheet for coupling the sheet with the die holder in a second orientation with respect to the die holder. The first and second sets of apertures also allow the die to be selectively placed in more than one position relative to the die holder, to alter the location in which the cutting edge forms the window opening in the blank or web.

Another embodiment of the present invention provides for a die that is adapted to be selectively coupled with either a first die holder or a second die holder to cut an opening in a blank or web a sheet of material. The first and second die holders may be different sizes and/or rotational cycles in order to cut window openings in different types of blanks or webs. The die comprises a top surface and an outer periphery. A raised portion having a perimeter protrudes from the top surface of the sheet and includes a cutting edge adapted to cut the blank or web to form the opening. First and second coupling means are formed in the sheet. The first coupling means is adapted to allow the sheet to be selectively coupled with the first die holder in a first orientation. The second coupling means is adapted to allow the sheet to be selectively coupled with the second die holder in a second orientation. The change in orientation of the sheet relative to the first and second die holders alters the location in which the cutting portion forms the opening in the blank or web.

A further embodiment of the present invention provides for a die that comprises a sheet of material including a top surface and an outer periphery. A raised portion has a perimeter that protrudes from the top surface of the sheet and includes a cutting edge adapted to cut the blank or web to form the opening. An aperture is formed in said sheet for coupling the sheet with the die holder in a first and second orientation with respect to the die holder so that the orientation of the sheet relative to the die holder may be selectively changed to alter the location in which the raised portion forms the window portion in the blank or web.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWINGS

In the accompanying drawings which form a part of the specification and are to be read in conjunction therewith and in which like reference numerals are employed to indicate like parts in the various views:

FIG. 3 is an enlarged cross-sectional view of the die taken along line 3—3 in FIG. 2 showing a raised edge that extends from the top surface of the die; and FIG. 4 is an exploded view similar to FIG. 1 showing how the die is coupled to the die holder using a second set of apertures.

DETAILED DESCRIPTION OF THE INVENTION

Figure 1:
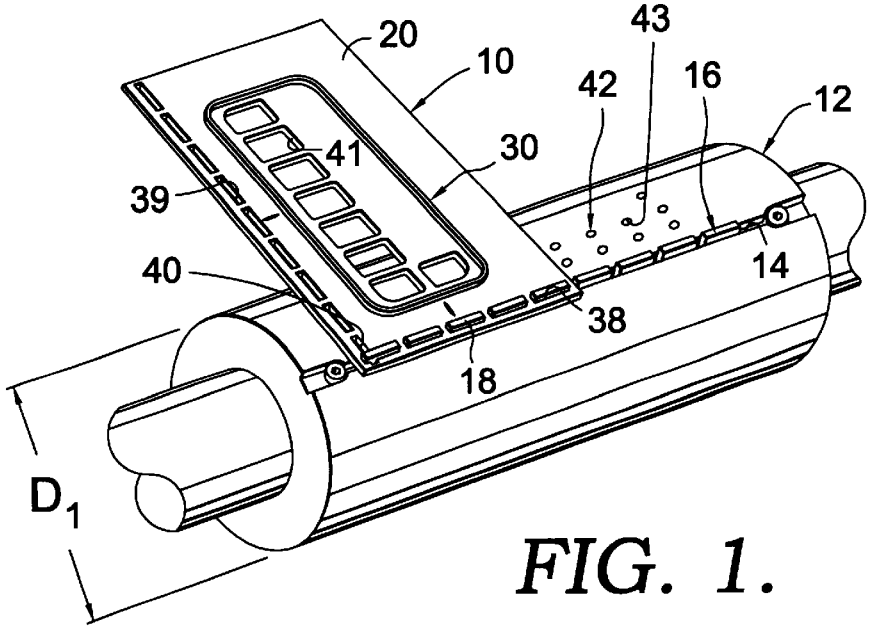
FIG. 1 is a top perspective view of a die according to a preferred embodiment of the present invention and having a portion thereof coupled with a die holder using a first set of apertures.

Referring now to the drawing in detail, and initially to FIG. 1, numeral 10 generally designates a die constructed in accordance with a preferred embodiment of the present invention. Die 10 is generally used in conjunction with a die holder 12 to cut a opening in a blank or web used to form an envelope, cardboard box or the like. Specifically, die 10 and die holder 12 each comprise coupling means by which die 10 may be selectively mounted to die holder 12 in more than one position. It will be understood and appreciated that die 10 may be used to form window or other types of openings in various types of envelopes such as, but not limited to, standard size ten envelopes, open-end style, booklet style and expansion style envelopes.

As best seen in FIG. 1, die holder 12 is generally cylindrical shaped and adapted to rotate about its longitudinal axis to intermittently place die 10 in a position to cut an opening in an envelope web or blank by passing adjacent to it. It should be understood that die holder 12 may utilize magnetic and/or non-magnetic fasteners for retaining die 10 on die holder 12. In this embodiment die holder 12 includes a recess 14 formed therein, and a pin bar 16 positioned within recess 14. Protrusions 18 extend from pin bar 16 and operate to couple with and releasably mount die 10 to die holder 12, as will be discussed in detail below. It will be understood and appreciated that die 10 is adapted to be coupled to one sized die holder in at least two orientations where $D_1$ equals $D_2$ as seen in FIGS. 1 and 4. However, it will also be understood and appreciated that die holders 12 illustrated in FIGS. 1 and 4 may have different diameters, $D_1$ and $D_2$, and/or rotational cycles adapted to form window portions in different styles of envelopes. For instance, the die holder 12 in FIG. 1 may have a diameter, $D_1$, of 8 inches and have a rotational cycle adapted to place die 10 in a position to form open-end style envelopes. In addition, the die holder 12 in FIG. 4 may have a diameter, $D_2$, of 5 inches and have a rotational cycle adapted to place die 10 in a position to form window openings standard size ten style envelopes.

Figure 2:
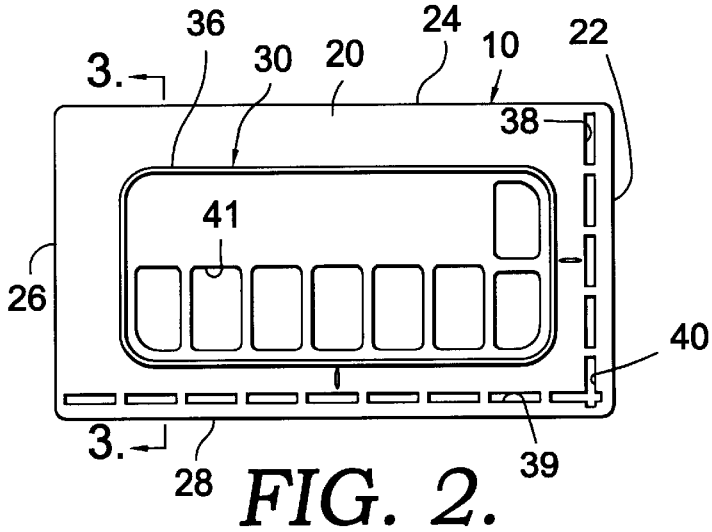
FIG. 2 is an enlarged plan view of the die shown in FIG. 1 illustrating the first and second set of apertures formed in the die.

As best seen in FIGS. 2 and 3, die 10 is a sheet of material that includes a top and bottom surface 20, 21. Top surface 20 is adapted to contact the envelope blank and cut an opening therein. Bottom surface 21 is adapted to contact the outer surface of die holder 12. In one embodiment, die 10 is generally rectangular shaped, having four edges 22, 24, 26, 28 that form an outer periphery. It will be understood and appreciated that die 10 may be formed in other shapes and sizes without departing from the scope of this invention. In addition, die 10 may be formed of any suitable flexible material such as, but not limited to, metal, rubber, polymeric material or any combination thereof. It is also contemplated that die be formed of a non-flexible or rigid material. A non-flexible die 10 could be used in conjunction a die holder that is adapted to oscillate along an axis to stamp die 10 over the envelope blank to cut the opening.

As best seen in FIG. 3, a raised portion 30 protrudes from top surface 20 of die 10, and is adapted to cut an opening in the envelope blank. In particular, raised portion 30 comprises a perimeter which includes two concave surfaces 32 that extend upwardly from top surface 20 with a surface 34 extending therebetween. The intersection of the concave surfaces with the top surface forms a cutting edge 36 that is used to pierce the envelope blank. In addition, the raised portion 30 may extend from top surface 20 in other shapes and sizes to vary the design of cutting edge 36, such as, but not limited to a V-shaped raised portion, and it is this contour of the cutting edge 36 that defines the shape of the opening to be cut in the envelope blank. Although various other shapes may be used, cutting edge 36 is generally rectangular shaped with rounded corners as best seen in FIG. 2.

As best seen in FIG. 2, a first and second coupling means comprise a first and second set of apertures 38, 39, respectively, formed in die 10 and adapted to couple die 10 with pin bar 16. First set of apertures 38 are positioned along edge 22 of die 10 and are shaped to correspond with pin bar 16. Second set of apertures 39 are positioned along edge 28 and correspond with pin bar 16. As can be seen, a portion of first and second set of apertures 38, 39 may overlap. Although depicted as being perpendicular with each other, it will be understood and appreciated that the direction in which first set of apertures 38 and/or second set of apertures 39 extend may be changed resulting in an increase or decrease in the angle formed therebetween. It is also contemplated that first and second set of apertures 38, 39 may be formed in different shapes, such as rectangular, circular or square slots, or sizes and be positioned in a variety of locations as long as die 10 is capable of engaging with pin bar 16 in more than two orientations. In addition, each of first and second coupling means may also comprise a single aperture that could be shaped to hold die 10 firmly in place on die holder 12 in at least two orientations while preventing any rotation of the die 10 on die holder 12. Moreover, it will also be understood that forming more than two sets of coupling means in die 10 is within the scope of this invention. Having more than two sets of coupling means allows for the die 10 to be coupled to the die holder 12 in more than two orientations.

Instead of utilizing first and second coupling means, it is also within the scope of this invention to use a single coupling means to change the orientation of the die 10 on the die holder 12. For instance, as best seen in FIGS. 1, 2 and 4, the single coupling means could comprise an aperture 40 shaped in such a way to position the die 10 in two orientations over the protrusions 18 of the pin bar 16.

As best seen in FIG. 2, a plurality of apertures 41 are formed in die 10 within the periphery of raised portion 30. Apertures 41 are positioned to allow a vacuum system 42 to remove a cut-out portion of the envelope from the envelope blank during the window forming process. As best seen in FIGS. 1 and 4, the vacuum system 42 includes a plurality of orifices 43 that are formed in the surface of die holder 12. The apertures 41 are positioned so that orifices 43 can be seen through apertures 41 when die 10 is positioned on or near die holder 12. The vacuum 42 is adapted to create a pressure differential at the orifices 43 to draw the cut-out portion of the envelope against die holder 12. Specifically, the arrangement of apertures 41 and orifices 43 allow the vacuum system 42 to pull the cut-out portion of the envelope blank away from the envelope blank as the window opening is formed in the envelope blank. Apertures 41 allow for the removal of the cut-out portion notwithstanding whether die 10 is coupled to die holder 12 through the use of first or second set of apertures 38, 39.

In use, pin bar 16 is placed in recess 14 formed in die holder 12. The protrusions 18 extending from pin bar 16 correspond with and are adapted to engage either first or second set of apertures 38, 39. The presence of first and second set of apertures 38, 39 allows die 10 to be coupled with die holder 12 in different orientations to alter the location in which the raised edge forms the window portion in an envelope blank. Therefore, the decision to couple die 10 with die holder 12 using first or second set of apertures 38, 39 often depends on the type of envelope being manufactured and the desired location of the window opening. For instance, first set of apertures 38 may be used if a window portion needs to be formed in an open-end style envelope. As best seen in FIG. 1, the protrusions on pin bar 16 are slid through first set of apertures 38 so that die 10 is coupled with die holder 12 having a diameter $D_1$. Magnetic and/or non-magnetic fasteners are adapted to position the bottom surface 21 of die 10 adjacent to or against die holder 12.

In one embodiment, as the envelope blank enters the window cutting portion of the manufacturing process, die holder 12 along with die 10 is rotating about its longitudinal axis. Cutting edge 36 pierces the envelope blank, and the cut-out portion of the envelope blank is drawn to top surface 20 of die 10 and held there by the pressure differential created by the vacuum system 42. Specifically, the vacuum system 42 applies a suction pressure through orifices 43 and apertures 41 to hold the cut-out portion of the envelope blank within the periphery of raised portion 30. After the window portion has been formed, the envelope blank proceeds through the manufacturing process and die holder 12 continues to rotate about its longitudinal axis, discarding the cut-out portion of the envelope blank. As die holder 12 rotates about its longitudinal axis, a valve, not shown, operates to turn of the vacuum system 42 thereby momentarily releasing the cut-out portion of the envelope from the die 10. Once the cut-out portion is released from die 10, a suction tube, not shown, is used to transport the cut-out portion to a location away from the die holder 12 so it does not interfere with the window cutting process. The vacuum system 42 is then reactivated after the cut-out portion is released from die 10. The process is repeated as the die holder 12 continues to rotate and the next envelope blank is moved adjacent to die 10.

The location of the window portion formed in the envelope blank may be altered by changing the orientation of die 10 relative to die holder 12 by removing die 10 from die holder 12 and coupling second set of apertures 39 with protrusions 18 in pin bar 16. For example, if a standard size ten envelope is being manufactured, then second set of apertures 39 would usually be used to form a window portion therein. As best seen in FIG. 4, the protrusions 18 located on pin bar 16 are slid through second set of apertures 39 so that die 10 is coupled with die holder 12. Magnetic and/or non-magnetic fasteners are adapted to position the bottom surface 21 of die 10 adjacent to or against die holder 12. The window portion of the envelope blank is formed in the same manner as discussed above, with the altered position of the window using the die 10 as thus positioned. It is within the scope of one embodiment of this invention that the die holder 12 illustrated in FIG. 4 have a diameter, $D_2$, that is equal to the diameter, $D_1$, of die holder illustrated in FIG. 1. Therefore, the die holder 12 in FIGS. 1 and 4 may be the same die holder, or two different die holders with the same diameters. It should also be understood that according to another embodiment, die 10 can be used with die holders having many different sized diameters. For instance, as best seen in FIGS. 1 and 4, die 10 may be used with a die holder 12 where $D_2$ is greater or less than $D_1$. Notwithstanding whether die 10 is used with the same die holder or with two different sized die holders, die 10 is adapted to be rotated relative to the one or more die holders to change the location of the window portion formed in different styles of envelopes.

Therefore, in accordance with the present invention, die 10 may be used to form a window portion in different types of envelope styles by utilizing either first or second set of apertures 38, 39 to couple die 10 with die holder 12. Die 10 is capable of being rotated between positions depending on the desired location of the window portion and the style of envelope. The present invention provides advantages over the prior art in that it reduces the number of dies that need to be purchased, stored and maintained in inventory in order to cut window portions in different types of envelopes.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A die adapted to be coupled with a die holder to cut an opening in a blank or web, said die comprising:

a sheet of material comprising a top surface and an outer periphery;

a raised portion having a perimeter which protrudes from the top surface of said sheet, said raised portion including a cutting edge for cutting the opening in the blank or web;

a first set of apertures comprising at least one first aperture defined in said sheet for selectively coupling said sheet with the die holder in a first orientation with respect to the die holder; and a second set of apertures comprising at least one second aperture defined in said sheet for selectively coupling said sheet with the die holder in a second orientation with respect to the die holder, wherein the first and second orientations are rotated with respect to each other.

2. The die as recited in claim 1, wherein said first set of apertures extends in a direction which is generally perpendicular with the direction in which said second set of apertures extends.

3. The die as recited in claim 1, wherein said first set of apertures at least partially overlaps with said second set of apertures.

4. The die as recited in claim 1, wherein said first and second sets of apertures are positioned adjacent to said periphery of said sheet.

5. The die as recited in claim 1, wherein said first and second sets of apertures are generally rectangular shaped.

6. The die as recited in claim 1, wherein said sheet includes at least one aperture defined within the perimeter of said raised portion.

7. The die as recited in claim 1, wherein said sheet is formed of a flexible material.

8. An apparatus adapted to be coupled with a die holder to cut an opening in a blank or web, said apparatus comprising:

a sheet of material comprising a top surface and an outer periphery;

a raised portion having a perimeter which protrudes from the top surface of said sheet, said raised portion including a cutting edge for cutting the opening in the blank or web; and an aperture formed in said sheet for selectively coupling said sheet with the die holder in a first and second orientation with respect to the die holder so that the orientation of said sheet relative to the die holder may be selectively rotated to alter the location and orientation in which the opening is cut in the blank or web, wherein the first and second orientations are rotated with respect to each other.

9. A die adapted to be coupled with a die holder to cut an opening in a blank or web, said die comprising:

a sheet of material comprising a top surface and an outer periphery;

a raised portion having a perimeter which protrudes from the top surface of said sheet, said raised portion including a cutting edge for cutting the opening in the blank or web;

a first coupling means associated with said sheet and oriented in a first direction; and a second coupling means associated with said sheet and oriented in a second direction, said first and second coupling means allowing said sheet to be selectively coupled with the die holder in at least two orientations so that the position of said sheet may be rotated relative to the die holder to alter the location in which said cutting portion forms the opening in the blank or web, wherein the first and second directions of orientation are rotated with respect to each other.

10. The apparatus as recited in claim 9, wherein said first and second directions are perpendicular to one another.

11. The apparatus as recited in claim 9, wherein said first and second coupling means overlap with one another.

12. The apparatus as recited in claim 9, wherein said first and second coupling means are located along the periphery of said sheet.

13. An apparatus that may be used with a die holder for cutting an opening in a blank or web, said apparatus comprising:

a sheet of material having a top surface and an outer periphery;

means for cutting the blank or web to define the opening;

means for coupling said sheet to the die holder, said means for coupling is used to selectively place the sheet in a first position relative to the die holder, and said means for coupling also being used to selectively place the sheet in a second position relative to the die holder so that the orientation of said sheet relative to the die holder may be selectively rotated to alter the location in which the raised portion defines the opening in the blank or web, wherein the first and second sheet positions are rotated with respect to each other.

14. An apparatus capable of being selectively coupled to either a first or a second die holder for cutting an opening in a blank or web, said apparatus comprising:

a sheet of material comprising a top surface and an outer periphery;

a raised portion having a perimeter which protrudes from the top surface of said sheet, said raised portion including a cutting edge for cutting the opening in the blank or web;

a first set of apertures comprising at least one first aperture defined in said sheet for coupling said sheet with the first die holder in a first orientation; and a second set of apertures comprising at least one second aperture defined in said sheet for coupling said sheet with the second die holder in a second orientation, wherein the first orientation of said sheet relative to the first die holder is different than the second orientation of said sheet relative to the second die holder, and wherein the first and second orientations are rotated with respect to each other.

15. The apparatus as recited in claim 14, wherein the first die holder is generally cylindrical and has a diameter of approximately 5 inches.

16. The apparatus as recited in claim 14, wherein the second die holder is generally cylindrical and has a diameter of approximately 8 inches.

17. The die as recited in claim 14, wherein said first set of apertures extends in a direction which is generally perpendicular with the direction in which said second set of apertures extends.

18. The die as recited in claim 14, wherein said first set of apertures overlaps with said second set of apertures.

19. The die as recited in claim 14, wherein said first and second set of apertures are positioned adjacent to said periphery of said sheet.

20. The die as recited in claim 14, wherein said first and second set of apertures are generally rectangular shaped.

21. The die as recited in claim 14, wherein said sheet includes at least one aperture defined within the perimeter of said raised portion.

22. The die as recited in claim 14, wherein said sheet is formed of a flexible material.

23. A die adapted to be selectively coupled with either a first or a second die holder to cut an opening in a blank or web, said die comprising:

a sheet of material comprising a top surface and an outer periphery;

a raised portion having a perimeter which protrudes from the top surface of said sheet, said raised portion including a cutting edge adapted to cut the blank or web to form the opening; and an aperture defined in said sheet for selectively coupling said sheet with the first die holder in a first orientation, said aperture further adapted for selectively coupling said sheet with the second die holder in a second orientation so that the orientation of said sheet may be rotated when transferring the sheet between the first and second die holders to alter the location in which said cutting portion defines the opening in the blank or web, wherein the first and second orientations are rotated with respect to each other.

24. A die adapted to be selectively coupled with either a first or a second die holder to cut an opening in a blank or web, said die comprising:

a sheet of material comprising a top surface and an outer periphery;

a raised portion having a perimeter which protrudes from the top surface of said sheet, said raised portion including a cutting edge for cutting the opening in the blank or web;

a first coupling means associated with said sheet and oriented in a first direction; and a second coupling means formed in said sheet and oriented in a second direction, said first coupling means allowing said sheet to be selectively coupled with the first die holder in a first orientation, and second coupling means allowing said sheet to be selectively coupled with the second die holder in a second orientation so that the orientation of said sheet may be rotated when transferring the sheet between the first and second die holders to alter the location in which the opening is located in the blank or web, wherein the first and second orientations are rotated with respect to each other.

25. The apparatus as recited in claim 24, wherein the first die holder is generally cylindrical and has a diameter of approximately 5 inches.

26. The apparatus as recited in claim 24, wherein the second die holder is generally cylindrical and has a diameter of approximately 8 inches.

27. The apparatus as recited in claim 24, wherein said first and second directions are perpendicular to one another.

28. The apparatus as recited in claim 24, wherein said first and second coupling means overlap with one another.

29. The apparatus as recited in claim 24, wherein said first and second coupling means are located along the periphery of said sheet.

* * * * *